United States Patent [19]

Rodda et al.

[11] Patent Number: 4,524,708

[45] Date of Patent: Jun. 25, 1985

[54] NOISE SUPPRESSION AND THREAD CONTROL ARRANGEMENT FOR A SEWING MACHINE

[75] Inventors: Donald Rodda, Butler; Charles R. Odermann, Montville, both of N.J.

[73] Assignee: The Singer Company, Stamford, Conn.

[21] Appl. No.: 639,660

[22] Filed: Aug. 13, 1984

[51] Int. Cl.[3] ..... D05B 57/08

[52] U.S. Cl. ..... 112/231

[58] Field of Search ..... 112/181, 183, 184, 228, 112/229, 230, 231

[56] References Cited

U.S. PATENT DOCUMENTS

| | | | |
|---|---|---|---|
| 1,996,290 | 4/1935 | Gunther | 112/184 |
| 2,544,227 | 3/1951 | Hohmann . | |
| 3,106,176 | 10/1963 | Doerner | 112/181 X |
| 3,379,150 | 4/1968 | Johnson . | |
| 3,382,826 | 5/1968 | Johnson | 112/184 |
| 3,386,401 | 6/1968 | Johnson . | |
| 3,416,472 | 12/1968 | Johnson | 112/228 X |
| 4,259,914 | 4/1981 | Johnson | 112/184 |

*Primary Examiner*—Wm. Carter Reynolds

*Attorney, Agent, or Firm*—William V. Ebs; Robert E. Smith; Edward L. Bell

[57] ABSTRACT

A bobbin case, which is loosely confined within the looptaker of a sewing machine, is biased both into engagement on one side against the looptaker and about the looptaker axis toward a position of engagement with a stop by a continuously engaging light force applying resilient member, and a shock absorber is disposed for engagement with the bobbin case only upon movement thereof through a predetermined distance in opposition to the bias of said resilient member.

5 Claims, 8 Drawing Figures

NOISE SUPPRESSION AND THREAD CONTROL ARRANGEMENT FOR A SEWING MACHINE

BACKGROUND OF THE INVENTION

1. Field of the Invention

The invention is directed to a rotatable looptaker and bobbin case assembly for use in a lockstitch sewing machine.

2. Description of the Prior Art

A bobbin case can only be loosely confined within the looptaker of a lockstitch sewing machine because a loop of thread must be moved about the bobbin case to form a stitch. Such loose confinement has permitted movement of the bobbin case within the looptaker and a resulting high level of bobbin case noise during the operation of the machine.

It is a prime object of the present invention to minimize bobbin case noise in a lockstitch sewing machine.

It is another object of the invention to resiliently restrict the movement of a bobbin case in a sewing machine by forces resulting from frictional engagement of the looptaker with bobbin case and the engagement with the bobbin case of an encircling thread loop during operation of the machine.

It is also an object of the invention to control the movement of a bobbin case in a lockstitch sewing machine with a light force applying member and a cushioning shock absorber in a manner enabling a thread loop to be moved about the bobbin case as required for proper stitch formation.

Other objects and advantages of the invention will become apparent during a reading of the specification taken in conjunction with the accompanying drawings.

SUMMARY OF THE INVENTION

A lockstitch sewing machine, including a rotatable vertical axis looptaker with a beak for seizing needle thread during looptaker rotation in a defined direction, and including a bobbin case that is loosely confined by the looptaker, is provided with a light force applying resilient member in continuous biasing engagement with the bobbin case for urging one side of the bobbin case against the looptaker, and said bobbin case rotationally with respect to the looptaker axis in a direction opposite to said defined direction of rotation of the looptaker toward a position of engagement with a stop which is fixedly located on the machine bed. A resilient shock absorber located a predetermined distance from the bobbin case in a position adjacent the bobbin case is engageable thereby only upon movement of the bobbin case in opposition to the bias of said resilient member.

DESCRIPTION OF THE PREFERRED EMBODIMENT

Figure 1:
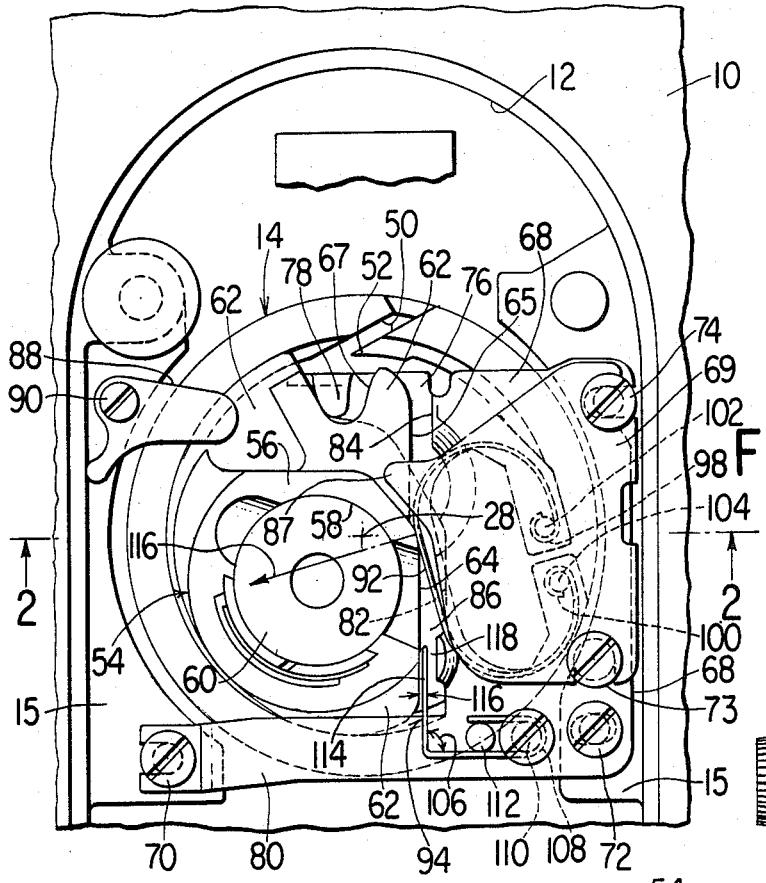
FIG 1 is a fragmentary top plan view showing a looptaker and bobbin case assembly according to the invention before rotation of the looptaker.
Figure 2:
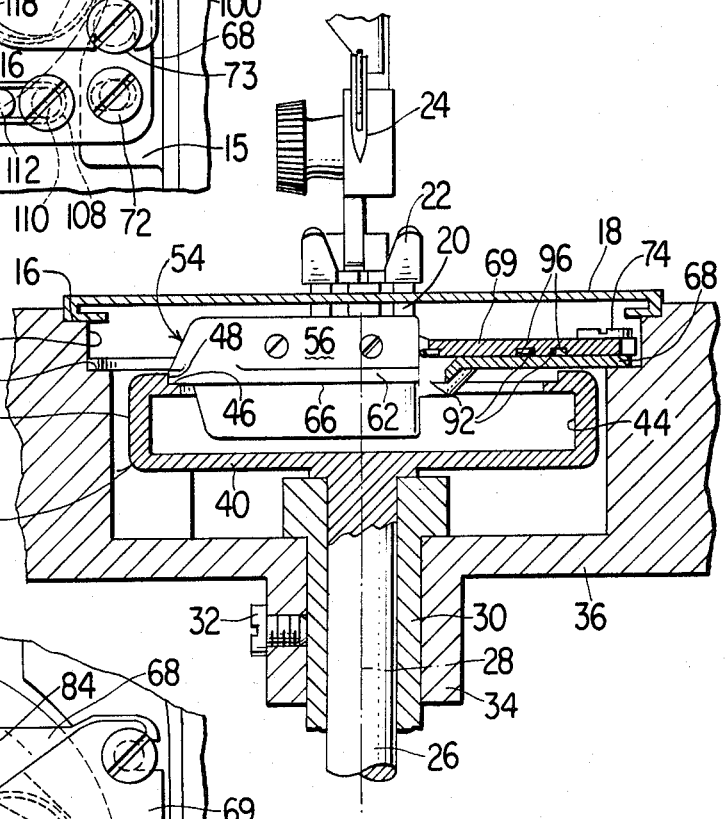
FIG. 2 is a vertical sectional view taken on the plane of the line 2—2 of FIG. 1.
Figure 3:
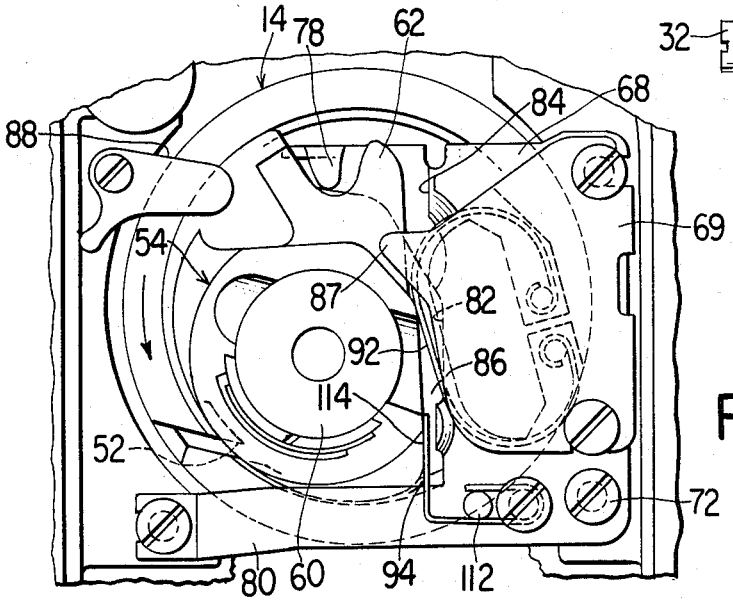
FIG. 3 is a view similar to FIG. 1 illustrating the effect of looptaker rotation on the bobbin case.

Referring to FIGS. 1, 2 and 3 of the drawings, reference character 10 designates a sewing machine bed with an upwardly open compartment 12 for a looptaker 14. Compartment 12 is formed with a lower and upper shelf 15 and 16, respectively. The upper shelf accommodates a slide plate cover 18 and a throat plate (not shown). Compartment 12 also accommodates a feed dog 20 of a conventional drop mechanism which may be opposed by a conventional presser foot 22 mounted in a bracket arm (not shown) of the sewing machine along with a needle 24 to which endwise reciprocating motion may be imparted in the usual manner.

Looptaker 14 includes a shaft 26 which is journalled for rotation about vertical axis 28 in a bushing 30 secured by a set screw 32 in a boss 34 depending from the bottom wall 36 of compartment 12. As shown, the looptaker includes a cup shaped body portion 38 with a flat bottom 40 and a cylindrical side wall 42 encompassing an upwardly open cavity 44. Side wall 42 is formed with an inwardly extending bearing rim 46 and an upwardly extending bearing shoulder 48. A vertical slot 50 in side wall 42 defines an inwardly directed needle loop seizing beak 52 in body portion 38. Counterclockwise rotation of the looptaker 14 (as viewed in the top views of the drawings), and endwise reciprocation of the needle 24 in timed relation relative to the looptaker is provided for with conventional mechanism (not shown) which is preferably adapted to impart two revolutions to the looptaker for each reciprocation of the needle.

A bobbin case 54 is received in looptaker cavity 44. The bobbin case includes a central portion 56 with a cylindrical bobbin accommodating cavity 58 wherein a conventional bobbin 60 is supported for rotation. The bobbin case also includes a flange 62 extending radially outward from central portion 56. As shown, the flange is mostly curved, but includes slabbed edge portions 64 and 65 on one side of the bobbin case. The flange has a planar underside 66 and includes a curvilinear notch 67.

A bracket 68 and overlying plate 69 are adjustably secured by screws 70, 72, 73 and 74 to shelf 15 in looptaker compartment 12. The bracket includes a short arm 76 with a top projecting tab 78 which extends just forwardly of the line of reciprocation of needle 24 into bobbin case notch 67 where it is loosely received. The bracket further includes second arm 80 which is parallel to arm 76 and overlies the forward edge of the bobbin case. The bracket is formed with straight edge portions 82 and 84 which lie adjacent the slabbed edge portions of the bobbin case, and provide an exit passageway 86 between the bobbin case and bracket for needle thread moved about the bobbin case during the operation of the machine. Plate 69 is formed with a tongue 87 which overlies the bobbin case flange 62 as shown.

The bobbin case 54 is vertically supported by arm 76 on opposite sides of tab 78, and by engagement of rim 46 of the looptaker with a portion of the underside 66 of the bobbin case flange 62. Bracket arm 80, the tongue 87 of plate 69, and a dog 88 removable secured to shelf 15 with a screw 90 so as to extend over flange 62, loosely confine the bobbin case axially. A resilient member 92 extends into passageway 86 to engage the bobbin case 54 and bias the bobbin case generally leftward as viewed in the drawings. A resilient shock absorber 94, which extends into the forward end portion of the passageway, and tab 78 on bracket 68 loosely confine the bracket case rotationally.

Resilient member 92 is a looped wire spring located between plate 69 and bracket 68, and extending through a recess 96 in the underside of plate 69 where opposite ends 98 and 100 of the spring are wrapped about posts 102 and 104 respectively. The spring extends across passageway 86, as shown, to engage the bobbin case bracket. Shock absorber 94 is wire spring with a ninety degree bend 106. One end portion 108 of spring 94 is wrapped about a pin 110 in bracket 68 and engaged by a bracket affixed stop 112 as shown, whereas the opposite end portion 114 extends into passageway 86.

Spring 92 continuously exerts a light biasing force on bobbin case 54 insufficient to interfere with the movement of thread about the left side of the bobbin case, through passageway 86 and past the spring 92. The spring acts generally to the left as already noted, and so urges the left side of the bobbin case to engagement with looptaker shoulder 48. The disposition of spring 92 is such that the directional line 116 of the force exerted by spring 92 on the bobbin case passes forwardly of the axis 28 of looptaker 14 wherein the bobbin case is supported on rim 46. Spring 92, therefor, also acts to rotate the bobbin case in a clockwise direction about the looptaker axis to a limited position of engagement in notch 67 with tab 78 acting as stop.

Shock absorber spring 94 is so located as to have end portion 114 separated from bobbin case edge portion 65 by a predetermined gap 116 while the looptaker 14 is stationary. Space 118 is provided behind the spring to permit flexure in the direction of bracket 68. Counterclockwise rotation of the looptaker, initiated by operation of the machine, causes the frictionally engaged bobbin case 54 to be pivoted in a counterclockwise direction about the looptaker axis. The bobbin case initially impacts against spring end portion 114 and thereafter bears against the spring while the looptaker is rotated. The bobbin case can only be caused to engage spring end portion 114 by being moved through gap 116 against the bias of spring 92 to increase the compression thereof. Spring 92 therefor exerts a measure of control over the force exerted on spring 94 during the operation of the machine, and by lessening the forces on spring 94 facilitates the movement of thread past spring end portion 114 in passageway 86.

The manner in which sewing threads are manipulated in the assembly of the invention to provide for the formation of lockstitches may be readily seen in FIGS. 4 through 8 wherein N and B designate needle thread and bobbin thread, respectively. The bobbin thread B during sewing extends from a thread guiding notch 120 in the bobbin case 54, across the top of the bobbin and bobbin case, and thence to stitches being formed in the work.

Figure 4:
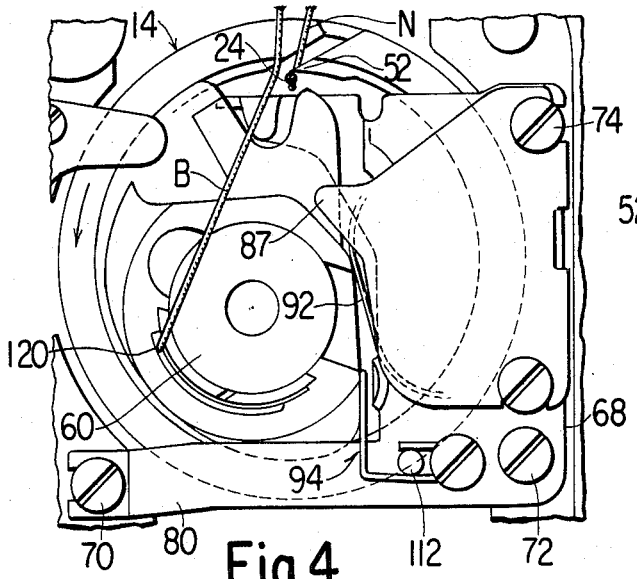
FIGS. 4 through 8 are top plan views of the looptaker and bobbin case showing a needle thread loop in different positions as it is moved about the bobbin case.
Figure 5:
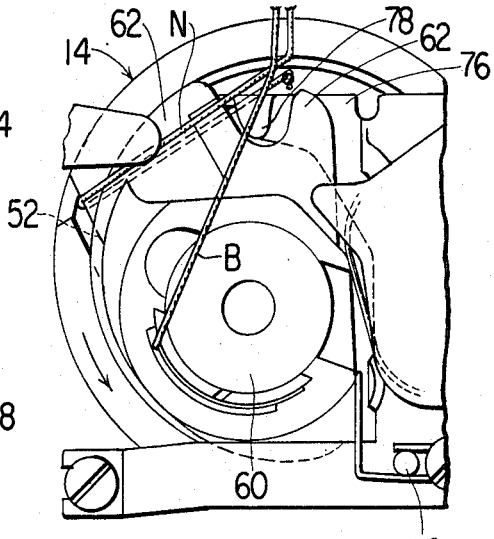
Figure 6:
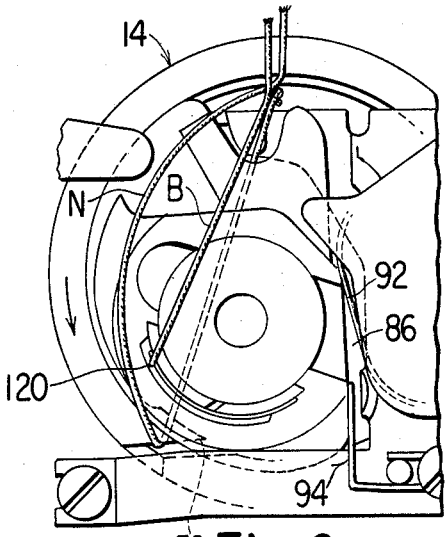
Figure 7:
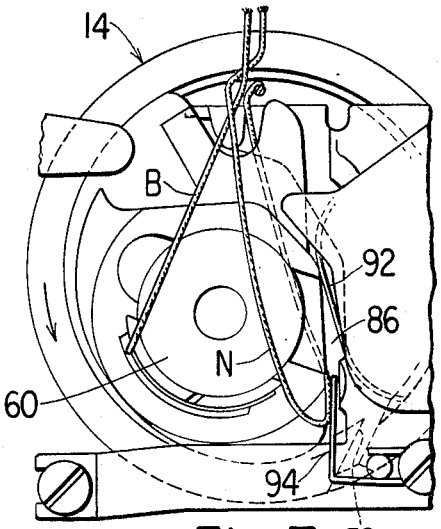
Figure 8:
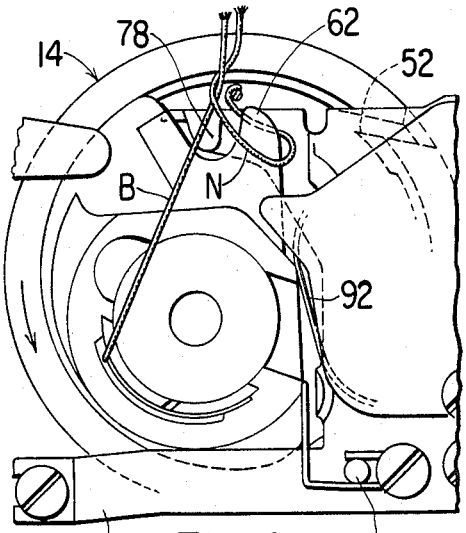

In FIG. 4, the looptaker 14 is shown at the moment the looptaker beak 52 seizes a loop of thread from needle 24. FIG. 5 illustrates the position of the looptaker shortly after needle loop seizure and as the seized needle thread loop is beginning to be spread about bobbin case flange 62 with one limb of the loop over the bobbin case and the other limb extending thereunder. In FIG. 6, the looptaker has progressed beyond the position shown in FIG. 5 to a point where beak 52 has just past notch 120 to dispose the upper and lower limbs of the needle thread loop as shown. In FIG. 7, the looptaker has moved beyond the position at which the needle thread loop is pulled from beak 52. The thread is pulled the rest of the way about the bobbin case by the usual takeup, and is shown in FIG. 7 as it is being pulled past spring 94 into passageway 86. In FIG. 8, the needle thread loop is pulled by the looptaker across the right rear end portion of bobbin case flange 62 for use in the formation of a stitch with bobbin thread B.

During the movement of the needle thread about the bobbin case as described, forces are exerted by the thread on the bobbin case tending to move the bobbin case laterally and axially. Such forces vary in magnitude and direction depending upon the position of the needle thread loop and tend to cause the bobbin case to chatter. However, springs 92 and 94, while permitting thread to pass about the bobbin case, both restrict movement of the bobbin case and resiliently control the limited movement permitted, thereby preventing noise and chatter of the bobbin case as otherwise experienced, especially at low speed.

It is to be understood that the present disclosure relates to a preferred embodiment of the invention which is for purposes of illustration only and is not to be construed as limiting the invention. Numerous alterations and modifications of the structure herein will suggest themselves to those skilled in the art, and all such modifications and alterations which do not depart from the spirit and scope of the invention are intended to be included within the scope of the appended claims.

We claim:

1. In a sewing machine, a bed, a looptaker mounted for rotation about a vertical axis in the bed and including a beak for seizing a loop of needle thread during looptaker rotation in a defined direction, a bobbin case loosely confined within the looptaker, a light force applying resilient member in continuous biasing engagement with the bobbin case for urging one side of the bobbin case against the looptaker and said bobbin case rotationally about the looptaker axis in a direction opposite to said defined direction of rotation of the looptaker for engagement with a stop having a fixed position in the bed, and a resilient shock absorber spaced a predetermined distance from the bobbin case in a position adjacent the bobbin case for engagement thereby only upon movement of the bobbin case in opposition to the bias of said resilient member.

2. The combination of claim 1 wherein the resilient member is a looped wire spring.

3. The combination of claim 1 wherein both the resilient member and shock absorber are wire springs.

4. The combination of claim 1 wherein said resilient member and shock absorber both extend into an exit passageway for thread loops movable about the bobbin case during the formation of stitches on the machine.

5. The combination of claim 4 wherein both said resilient member and shock absorber are mounted upon a member which forms said exit passageway with the bobbin case.

* * * * *